US012729028B1

(12) United States Patent
Van Der Steen et al.

(10) Patent No.: US 12,729,028 B1
(45) Date of Patent: Sep. 8, 2026

(54) AUTOMATED LOADING AND PACKING FOR CUSTOM-SIZED PACKAGES

(71) Applicant: Amazon Technologies, Inc., Seattle, WA (US)

(72) Inventors: Wouter Van Der Steen, Lebbeke (BE); Bert Heysse, Ertvelde (BE); Bart De Smet, Lede (BE); Peter Van Avermaet, Sint-Gillis-Waas (BE); Tom Van Moer, Temse (BE)

(73) Assignee: Amazon Technologies, Inc., Seattle, WA (US)

( * ) Notice: Subject to any disclaimer, the term of this patent is extended or adjusted under 35 U.S.C. 154(b) by 260 days.

(21) Appl. No.: 18/739,746

(22) Filed: Jun. 11, 2024

(51) Int. Cl.

| | |
|---|---|
| ***B65B 59/00*** | (2006.01) |
| ***B65B 5/04*** | (2006.01) |
| ***B65B 35/10*** | (2006.01) |
| ***B65B 57/14*** | (2006.01) |
| ***B65B 65/00*** | (2006.01) |

(52) U.S. Cl.
CPC ..... *B65B 57/14* (2013.01); *B65B 5/04* (2013.01); *B65B 35/10* (2013.01); *B65B 59/00* (2013.01); *B65B 65/006* (2013.01); *B65B 2210/02* (2013.01); *B65B 2210/04* (2013.01)

(58) Field of Classification Search
None
See application file for complete search history.

(56) References Cited

U.S. PATENT DOCUMENTS

| | | | | |
|---|---|---|---|---|
| 10,118,723 | B2 * | 11/2018 | Clark | B65B 5/00 |
| 2022/0048658 | A1 * | 2/2022 | Langen | B65B 43/145 |
| 2024/0140711 | A1 * | 5/2024 | Tanaka | B65G 1/1371 |
| 2025/0263236 | A1 * | 8/2025 | Langen | B65G 1/1375 |

* cited by examiner

*Primary Examiner* — Tanzim Imam
(74) *Attorney, Agent, or Firm* — Eversheds Sutherland (US) LLP

(57) ABSTRACT

Systems and methods are disclosed for automated loading and packing for custom-sized packages. In one embodiment, an example system may include a first custom-sized package generation machine configured to generate packaging having a first range of dimensions, a second custom-sized package generation machine configured to generate packaging having a second range of dimensions, and a first independent transport robot configured to transport items to at least one of the first and second custom-sized box generation machines. The first custom-sized package generation machine and second first custom-sized package generation machine are decoupled from an item induction portion of the system.

20 Claims, 9 Drawing Sheets

AUTOMATED LOADING AND PACKING FOR CUSTOM-SIZED PACKAGES

BACKGROUND

As users increasingly make online purchases, fulfilment of such purchases and other orders may become increasingly complicated. For example, a fulfillment center may have output of upwards of one million packages per day. With such demands, efficiency of logistics related to processing orders and packages may be important. Accordingly, improvements in various operations of order fulfillment, such as improvements to picking technology, sorting technology, packing technology, and so forth may be desired, such that manual efforts can be redirected to different tasks. Moreover, in some instances, single items may be packed in containers for shipment. However, such items may be of different shapes and sizes. Accordingly, custom sized containers for shipping may be desired.

Figure 1:
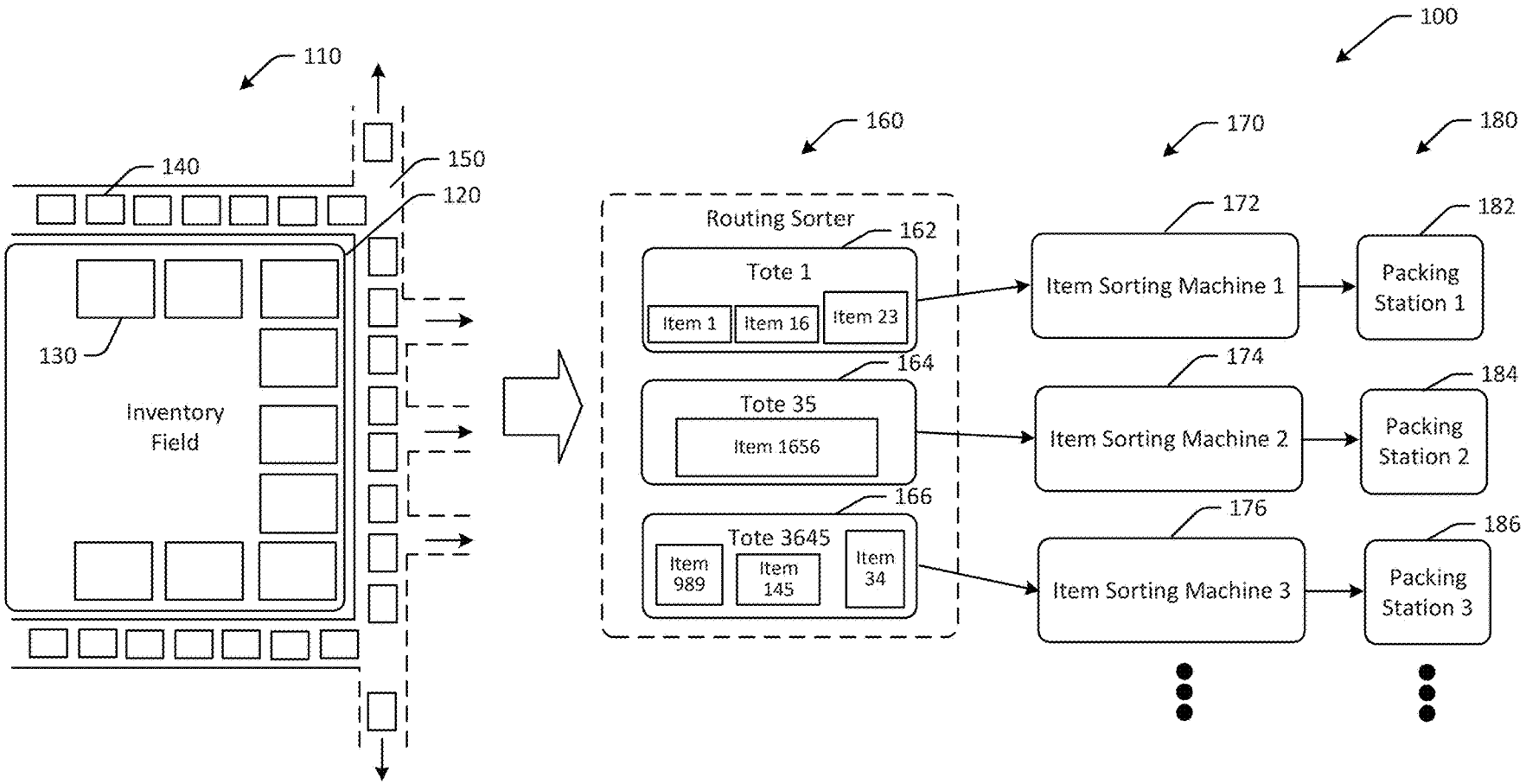
FIG. 1 is a hybrid schematic illustration of an example use case for automated loading and packing for custom-sized packages and an example process flow in accordance with one or more embodiments of the disclosure.

The detailed description is set forth with reference to the accompanying drawings. The drawings are provided for purposes of illustration only and merely depict example embodiments of the disclosure. The drawings are provided to facilitate understanding of the disclosure and shall not be deemed to limit the breadth, scope, or applicability of the disclosure. The use of the same reference numerals indicates similar, but not necessarily the same or identical components. Different reference numerals may be used to identify similar components. Various embodiments may utilize elements or components other than those illustrated in the drawings, and some elements and/or components may not be present in various embodiments. The use of singular terminology to describe a component or element may, depending on the context, encompass a plural number of such components or elements and vice versa.

DETAILED DESCRIPTION

Overview

Fulfillment centers may be used to fulfill online purchases and other orders. For example, fulfillment centers may include product inventory that may be pulled when an order for a particular product or multiple products is placed. In some instances, the product(s) may be packed and shipped from the fulfillment center. However, the process of obtaining the product(s), packing the product(s), and shipping the product(s) may be complicated due to the amount of inventory, the number of orders to process, the size of the fulfillment center, and/or other factors. In addition, a portion of the fulfillment center designated for packing or shipping may be different than the portion of the fulfillment center designated for holding product inventory. As a result, transportation of products in an order may be time consuming. In addition, a number of different types of containers may be used to pack items into for shipping. For example, container types or packaging may include boxes, bags, flexible containers (e.g., paper mailers, bubble wrap mailers, etc.) and/or other types of containers. Some containers may be have fixed sizes or dimensions, and may therefore be larger than an item that is packed inside, resulting in the use of bubbles, packing paper, or other fillers to reduce a likelihood of damage to the item during transit. In addition, certain containers may be formed of non-recyclable materials, such as certain types of plastic. Accordingly, custom-sized or right-sized containers that are made of recyclable or other materials may be desired so as to not only reduce environmental impact, but also to reduce waste and packaging material consumption due to custom-sized containers for items, thereby removing the need for fillers and avoiding containers that are too big relative to the size of the item(s) in the container.

For custom-sized packages, handling of items during placement of the item into the right-sized or custom-sized packages may be difficult due to limited room for error and the similarity in package dimensions to the item dimensions (or combined item dimensions for multi-item packages). Such issues may be resolved with manual intervention; however, this may reduce throughput of packages in a facility.

Embodiments of the disclosure include systems and methods for automated loading and packing for custom-sized packages. Using the system structure and components described herein, items may be loaded into custom-sized packages, packed, and shipped without any, or with limited manual intervention. In addition, an overall system footprint may be reduced while maintaining or increasing throughput and/or capacity. Some embodiments may allow for reconfiguration of packaging or box generation systems to accommodate high volumes of items having a similar size, particularly for embodiments where different box generation systems may have different ranges of box dimensions the system is configured to output. Independent transport robots, such as drive robots, that handle items for packing may be configured to transport items to multiple box generation systems, where the decoupling of box generation systems from induction systems and/or drive robots provides added flexibility to reduce bottlenecks and maintain consistent throughput. Accordingly, waste in the form of oversized packaging can be reduced, and throughput can be increased due to increased system flexibility and component arrangement.

Embodiments of the disclosure can be used with any suitable type of custom-sized package, such as roll-formed containers for shipping that may improve packing quality (e.g., items may not move within the container as the container is custom sized around the item, etc.), and reduce environmental impact by providing a recyclable package that can be recycled after delivery. Some embodiments may produce roll-formed containers to ship items without waste or scrap, providing environmental benefits. Certain embodiments include custom container formation equipment that can be used to produce containers that are sized based at least in part on dimensions of an item to be packed inside the container. The containers may be formed of a single sheet of roll-formed material, such as a fiber-based material, at least partially fiber-based material, a paper-based material (e.g., unpadded cardboard, single-sided or double-sided corrugate, a non-Gaussian material, etc.) that is formed around the item to be packed. Containers may be output at a rate of up to or greater than 2,000 units per hour.

As a result of the improve functionality provided by the systems and methods described herein, throughput of the processing of items at the fulfillment center may be increased. Some embodiments include optimized process flows for processing of orders at fulfillment centers, as well as process flows or methods to increase speed of consolidating products in a multi-item order as a result of improved speed in transportation of items and/or containers. As a result, throughput of fulfillment centers may be improved, and/or logistics of fulfillment center operations may be less complicated.

Referring to FIG. 1, an example use case 100 for automated loading and packing for custom-sized packages and an example process flow in accordance with one or more embodiments of the disclosure. Although discussed in the context of online orders, other embodiments may be directed to any suitable use case where objects are packed into containers, such as instances where items for single item orders that are picked from inventory and placed into flexible containers for shipment, and so forth.

In FIG. 1, a fulfillment center may include an inventory field 110, a routing sorter 160, one or more item sorting machines 170, and one or more packing stations 180. The inventory field 110 may be include a storage platform, or a portion of the fulfillment center at which products picked from product inventory are placed. Robots may be used to pick products from inventory and to deliver to the robotic storage platform in some instances, while in other instances, manual labor or a combination thereof may be used to pick products. The picking process at the robotic storage platform may include locating a product in an order, obtaining the product, and sending the product to a robotic storage platform, such as via a conveyor belt. In the illustrated embodiment, products at the robotic storage platform may be placed in a container, such as a tote.

The inventory field 110 may include multiple items that are in inventory. The items may be used to fulfill orders. The inventory field 110 may be a robotic field in some instances. One or more picking stations 130 may be positioned along a perimeter 120 of the inventory field 110. The picking stations 130 may be manually operated or may include robotic components, or a combination thereof. In some instances, picking of items from the inventory field 110 may be completed by robots, where the items are delivered to the picking stations 130 after being retrieved from the inventory field 110. Any number of picking stations 130 may be included, and the picking stations 130 may be located in a different position than that illustrated in FIG. 1.

One or more conveyors 150 may be disposed about the inventory field 110. For example, conveyors 150 may be disposed along the perimeter 120 of the inventory field 110. The conveyors 150 may run adjacent to the picking stations 130 in some embodiments. Any suitable conveyor configuration may be used. In the illustrated example, the conveyors 150 may include belts or rollers that run alongside the picking stations 130 and include one or more paths to one or more routing sorters.

The conveyors 150 may be used to transport one or more totes 140. For example, as totes 140 move along the conveyors 150, items may be moved from the picking stations 130 into respective totes 140. The totes 140 may be associated with particular item sorting machines, and may be moved using the conveyors 150 to a routing sorter 160.

The routing sorter 160 may be configured to route, divert, or otherwise guide certain totes to an item sorting machine. The routing sorter 160 may include any combination of ramps, slides, rollers, arms, guides, and/or other components to route totes to a particular item sorting machine. At the routing sorter 160, totes including products that have been picked may be routed to the appropriate or designated item sorting machine. For example, the routing sorter 160 may determine an identifier associated with the tote, and may determine an item sorting machine associated with the tote using the identifier. The routing sorter 160 may route or direct the tote to the appropriate item sorting machine.

A number of item sorting machines 170 may be coupled to the routing sorter 160. For example, a first item sorting machine 172, a second item sorting machine 174, a third item sorting machine 176, and so forth may be coupled to the routing sorter 160. The routing sorter 160 may guide totes to the item sorting machines to which they are assigned (where applicable). For example, a first tote 162 may include item 1, item 16, and item 23, and may be assigned to the first item sorting machine 172. The routing sorter 160 may therefore route the first tote 162 to the first item sorting machine 172 for sortation of the respective items. A second tote 164 may include item 1656, and may be assigned to the second item sorting machine 174. The routing sorter 160 may therefore route the second tote 164 to the second item sorting machine 174 for sortation of the item. A third tote 166 may include item 989, item 145, and item 34, and may be assigned to the third item sorting machine 176. The routing sorter 160 may therefore route the third tote 166 to the third item sorting machine 176 for sortation of the respective items.

Some or all of the item sorting machines may be associated with one or more packing stations 180 that may be used to pack items into a shipment when a single-item or multi-item order is complete. For example, the first item sorting machine 172 may be coupled to a first packing station 182, the second item sorting machine 174 may be coupled to a second packing station 184, the third item sorting machine 176 may be coupled to a third packing station 186, and so forth. The item sorting machines may be configured to receive items from totes that have one or more, or multiple, items. The number of totes and/or the number of items associated with respective item sorting machines may be balanced, and multiple totes may be routed to the first item sorting machine 172 and the second item sorting machine 174 at the same time.

Some of the packing stations may be configured to pack items for single or multi-item orders into containers for shipment, such as custom-sized containers, instead of presized containers with fixed dimensions. In one example embodiment, container systems as described herein may be packing stations for single or multi-item orders, such that single or multiple items are placed into custom sized containers and transported downstream for shipment.

At any of the stages of the example fulfillment process of FIG. 1 where handling of objects is used, such as to pick items from inventory, place items in totes, remove items from totes, place items into bins, remove items from bins, place items into packages for shipping, and so forth, robotic manipulators may be used. As a result, manual effort can be redirected to other tasks.

Embodiments of the disclosure include custom-sized containers, such as roll-formed containers, for shipping. Certain embodiments may reduce waste and improve shipment quality by providing custom sized containers, and may improve processing speed and/or throughput of fulfillment centers. Certain embodiments may improve performance of mechanical equipment for packing, sortation, and/or consolidation of items. While described in the context of online orders, aspects of this disclosure are more broadly applicable to other forms of object handling.

Example embodiments of the disclosure provide a number of technical features or technical effects. For example, in accordance with example embodiments of the disclosure, certain embodiments of the disclosure may improve packing quality, reduce a likelihood of item or container damage, and improve processing speed, throughput, and/or efficiency of fulfillment centers. The above examples of technical features and/or technical effects of example embodiments of the disclosure are merely illustrative and not exhaustive.

One or more illustrative embodiments of the disclosure have been described above. The above-described embodiments are merely illustrative of the scope of this disclosure and are not intended to be limiting in any way. Accordingly, variations, modifications, and equivalents of the embodiments disclosed herein are also within the scope of this disclosure. The above-described embodiments and additional and/or alternative embodiments of the disclosure will be described in detail hereinafter through reference to the accompanying drawings.

Illustrative Embodiments and Use Cases

Figure 2A:
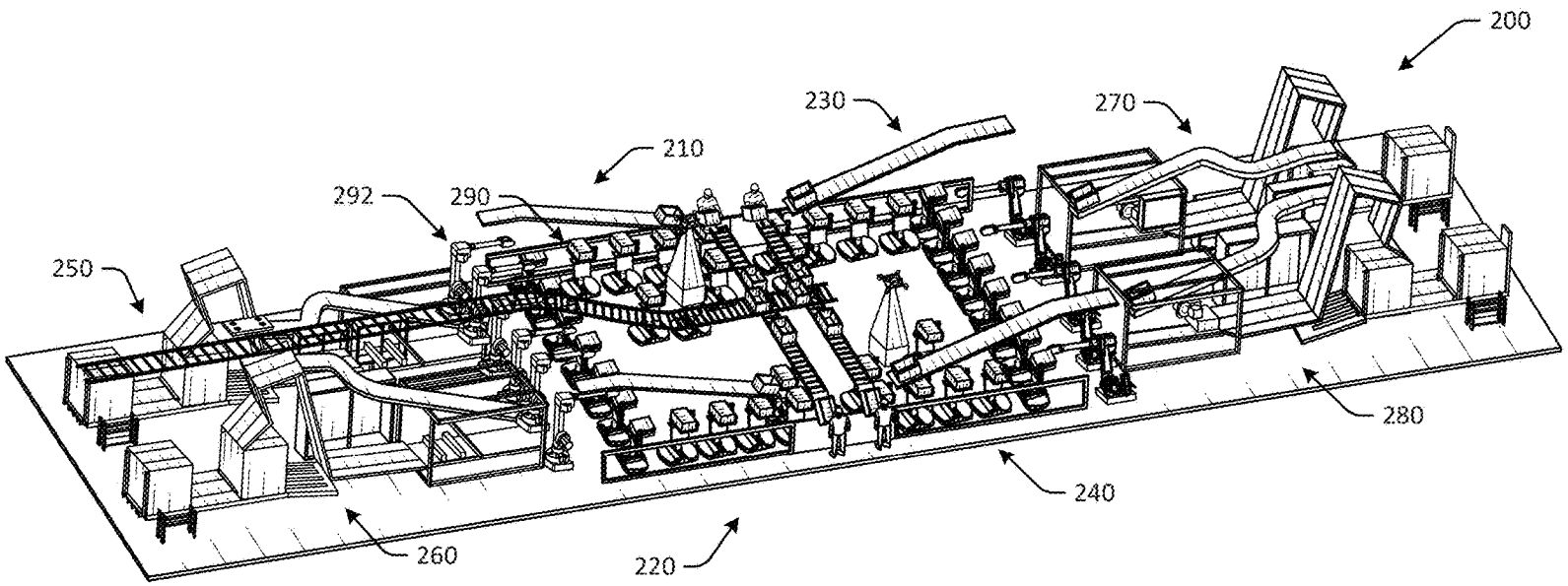
FIGS. 2A-2B are schematic illustrations of an example custom container shipping system in various views in accordance with one or more embodiments of the disclosure.
Figure 2A:
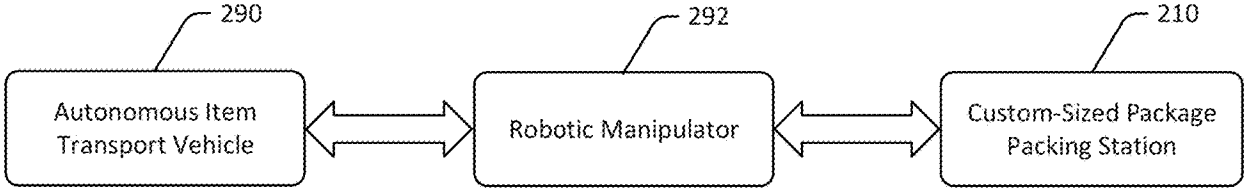
Figure 2B:
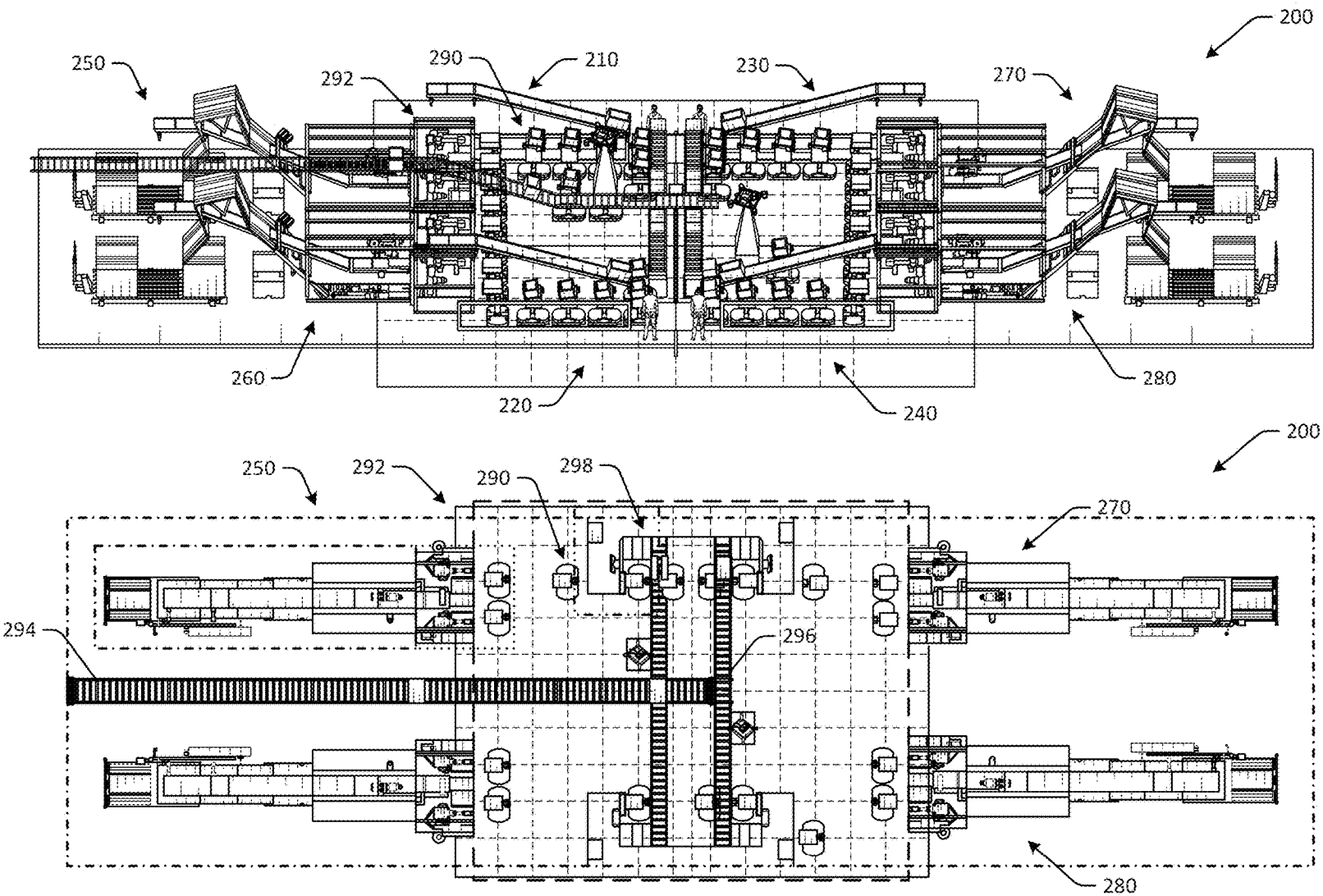

FIGS. 2A-2B are schematic illustrations of an example custom container shipping system 200 in various views in accordance with one or more embodiments of the disclosure. Other embodiments may include additional or fewer components. The illustrations of FIGS. 2A-2B may not be to scale, and may not be illustrated to scale with respect to other figures. The custom container generation system 200 illustrated in FIGS. 2A-2B is for illustrative purposes only, and other embodiments may have a different configuration. Some or all of the custom container generation system 200 may be used at, for example, any of the packing stations discussed with respect to FIG. 1.

In FIG. 2A, the custom container generation system 200 is depicted in perspective view. The custom container generation system 200 may be configured to generate custom-sized packages for single or multi-item orders. The custom container generation system 200 may include one or more packing stations at which items are placed into custom-sized packages and sealed. For example, the custom container generation system 200 may include a first packing station 210, a second packing station 220, a third packing station 230, a fourth packing station 240, and so forth. Items may be transported to the respective packing stations by one or more drive robots 290. The drive robots 290 may support individual item loading components that are used to place items into custom-sized containers for sealing and shipping. Custom-sized containers may be handled by one or more robotic manipulators 292 disposed at the respective packing stations. The robotic manipulator 292 may retrieve a custom-sized box or package, form the box and seal one end, coordinate movement with the drive robot to slide or dump the item into the custom-sized box, seal the other end, and then place the sealed package on a conveyor for downstream processing. For example, one or more conveyors may be used to transport packages downstream for shipment. A first conveyor 250 may be disposed adjacent to the first packing station 210, a second conveyor 260 may be disposed adjacent to the second packing station 220, a third conveyor 270 may be disposed adjacent to the third packing station 230, a fourth conveyor 280 may be disposed adjacent to the fourth packing station 240, and so forth. In some embodiments, the drive robot 290 may be an autonomous item transport vehicle. The drive robots 290 and the robotic manipulator 292 may be coupled to a central control system in some instances. One or both the drive robots 290 and the robotic manipulator 292 may have individual controllers and/or computer control systems.

The drive robots 290 may support item loading components that are configured to support items for a particular order on an L-shaped or V-shaped surface. The items may be slid or dumped off the item loading component and into a custom-sized package using gravity and tilting of the item loading component.

In FIG. 2B, the custom container generation system 200 is depicted in side perspective view and top view. The custom container generation system 200 may be a system for packing items into custom-sized packages. The custom container generation system 200 may include a first custom-sized package generation machine configured to generate packaging having a first range of dimensions, which may be part of the first packing station 210. The custom container generation system 200 may include a second custom-sized package generation machine configured to generate boxes having a second range of dimensions, which may be a part of the second packing station 220, a third custom-sized box generation machine configured to generate boxes having a third range of dimensions, which may be part of the third packing station 230, and a fourth custom-sized box generation machine configured to generate boxes having a fourth range of dimensions, which may be a part of the fourth packing station 240. Any number of custom-sized box generation machines may be included.

The different custom-sized box generation machines may have different configurations related to the sizes or dimensions of boxes the machine can produce. For example, the ranges of dimensions may be limited in some instances based on the size of the cardboard fed into the particular machine. However, there may be some overlap in dimensions between the machines as far as the dimensions of boxes that can be generated. For example, the first custom-sized box generation machine may be configured to produce boxes having lengths between 3 inches and 8 inches, and the second custom-sized box generation machine may be configured to produce boxes having lengths between 6 inches and 12 inches, where there is overlap in the ranges. This allows for either machine to accommodate items that fall at least within the overlapping ranges. In one embodiment, the first range of dimensions partially overlaps the second range of dimensions, and the third range of dimensions partially overlaps the fourth range of dimensions. In other embodiments, there may not be overlap between the ranges of the different custom-sized box generation machines. The custom-sized box generation machines may be configured to generate or produce various types of custom-sized boxes. However, in one embodiment, the custom-sized box generation machine may be unable to form wraparound packages.

In some embodiments, the first custom-sized package generation machine and second first custom-sized package generation machine are decoupled from an item induction portion of the system. For example, in FIG. 2B, an item induction portion 298 may be where items are inducted to the system for loading and packing into custom-sized boxes. The custom-sized box generation machines may be decoupled from the item induction portion or item induction system 298 so as to provide flexibility as to which custom-sized box generation machine an item is routed to. For example, a drive robot can route an item to any of the custom-sized box generation machines instead of being limited to a single one, which may be the case with a conveyor system. The item induction system 298 configured to induct items into the system 200 for packing into custom-sized packages.

The system 200 may include a first conveyor 296 configured to transport items to the drive robots 292 with or without containers. Inbound items may be routed from inbound conveyor 294 to the first conveyor 296 and then moved onto the drive robots 292 using a robotic manipulator or other automated process, or in some instances manually. The system 200 may include a second conveyor (e.g., conveyor 270, etc.) to transport empty containers downstream.

The system 200 may include a first drive robot configured to transport items to at least one of the first and second custom-sized box generation machines, and a second drive robot configured to transport items to both the first and second custom-sized box generation machines. The drive robots may optionally be configured to transport items to both the first and second custom-sized box generation machines. One or more sensors may be used to determine at least one dimension of an item while the item is disposed on a drive robot.

Accordingly, in one embodiment, an item packing facility may include an item induction system configured to induct a first item and a second item for packing into custom-sized packages, a first custom-sized package generation machine configured to generate boxes having a first range of dimensions, and a second custom-sized package generation machine configured to generate boxes having a second range of dimensions. The facility may include a first drive robot configured to transport the first item to at least one of the first and second custom-sized box generation machines, and a second drive robot configured to transport the second item to at least one of the first and second custom-sized box generation machines. The first custom-sized package generation machine and second first custom-sized package generation machine can be decoupled from the induction system.

Figure 3:
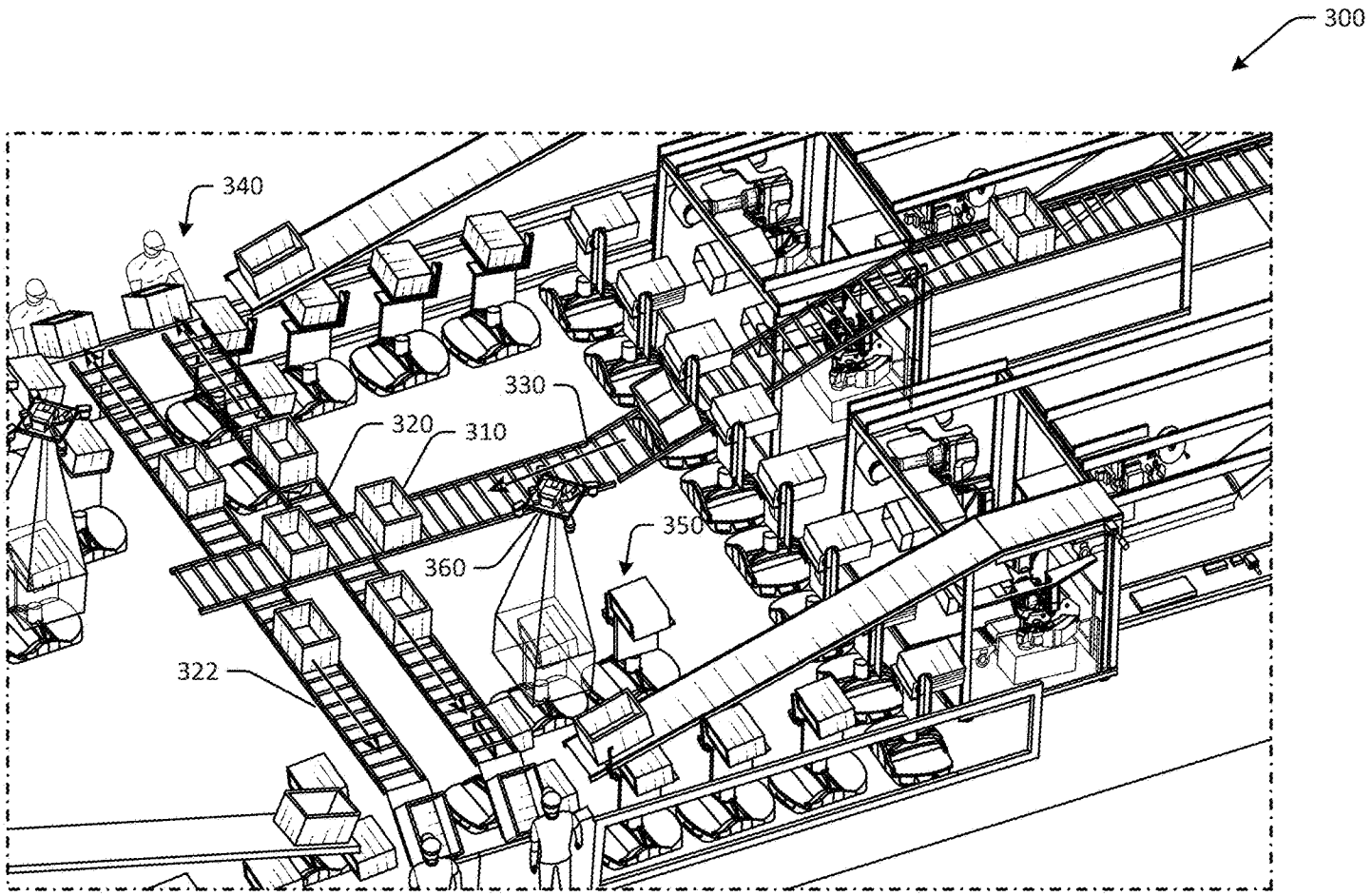
FIG. 3 is a schematic illustration of an example item loading process of a custom container shipping system in close-up view in accordance with one or more embodiments of the disclosure.

FIG. 3 is a schematic illustration of an example item loading process of a custom container shipping system in close-up view in accordance with one or more embodiments of the disclosure. Other embodiments may include additional or fewer components. The illustration of FIG. 3 may not be to scale, and may not be illustrated to scale with respect to other figures. The portion of the system depicted in the example of FIG. 3 is for illustrative purposes only. Other embodiments may have different configurations. The components illustrated in FIG. 3 may be the same components discussed with respect to FIGS. 1-2B.

In FIG. 3, a portion of a custom container shipping system 300 is depicted. The system 300 may include an inbound conveyor 330 that transports items to the system 300 for induction, where the items may be transported in containers 310. The containers 310 and/or items may be routed onto one or more conveyors 320, 322 to an item induction portion 340 or item induction system of the system 300. The item induction system may be configured to induct items into the system for packing into custom-sized packages. The items may be removed from the containers 310 in embodiments where containers are used, and loaded onto drive robots 350. In some embodiments, robotic arms or other manipulators may be used to load items onto the drive robots 350, whereas in other embodiments, the items may be loaded manually. Once the item is loaded onto the drive robot, one or more sensors 360 may be used to determine at least one dimension of the item. The dimension(s) may be used to determine the size of the custom-sized package that is to be generated and used to ship the item. Accordingly, in FIG. 3, the item may be moved toward the induction portion 340, an empty drive robot may be caused to approach the induction portion 340, and the item may be loaded onto the drive robot. The item may then be dimensioned using one or more sensors, such as camera sensors, depth sensors, optical sensors, photovoltaic sensors, and the like. In some embodiments, the drive robots may transport the items to a dimensions station for measurement.

In some embodiments, a local or remote controller of a custom-sized package generation system or a connected computer system may be used to control one or more of the conveyors, drive robots, box generation machines, sensors, and/or other components of the system 300. The controller may include memory having computer-executable instructions, and one or more computer processors configured to access the memory and execute the computer-executable instructions to perform one or more operations.

The controller may be configured to cause a first item to be loaded onto a first drive robot at the item induction portion 340. The controller may determine a first dimension of the first item, such as by using the sensor(s) 360. The sensor 360 may be a sensor configured to determine at least one dimension of an item while the item is disposed on the first drive robot. The controller may determine that the first item is to be routed to the first custom-sized package generation machine based at least in part on the first dimension of the first item and the first range of dimensions of the first custom-sized package generation machine, and may cause the first drive robot to transport the first item to the first custom-sized package generation machine. In some embodiments, instead of, or in addition to, selecting a package generation machine based on item dimension, embodiments may use other factors, such as a packaging material type associated with a particular item, a product geometry or shape, and so forth. For example, an item, such as a pack of golf balls, that is to be packaged in a soft pouch or flexible packaging, instead of rigid packaging, may be routed to a package generation machine that generates flexible packages. In another example, rollable items, such as basketballs, may be packaged based at least in part on product geometry or shape, where a particular machine is configured to generate rollable packages and/or other types of round or non-rectangular packages.

Figure 4:
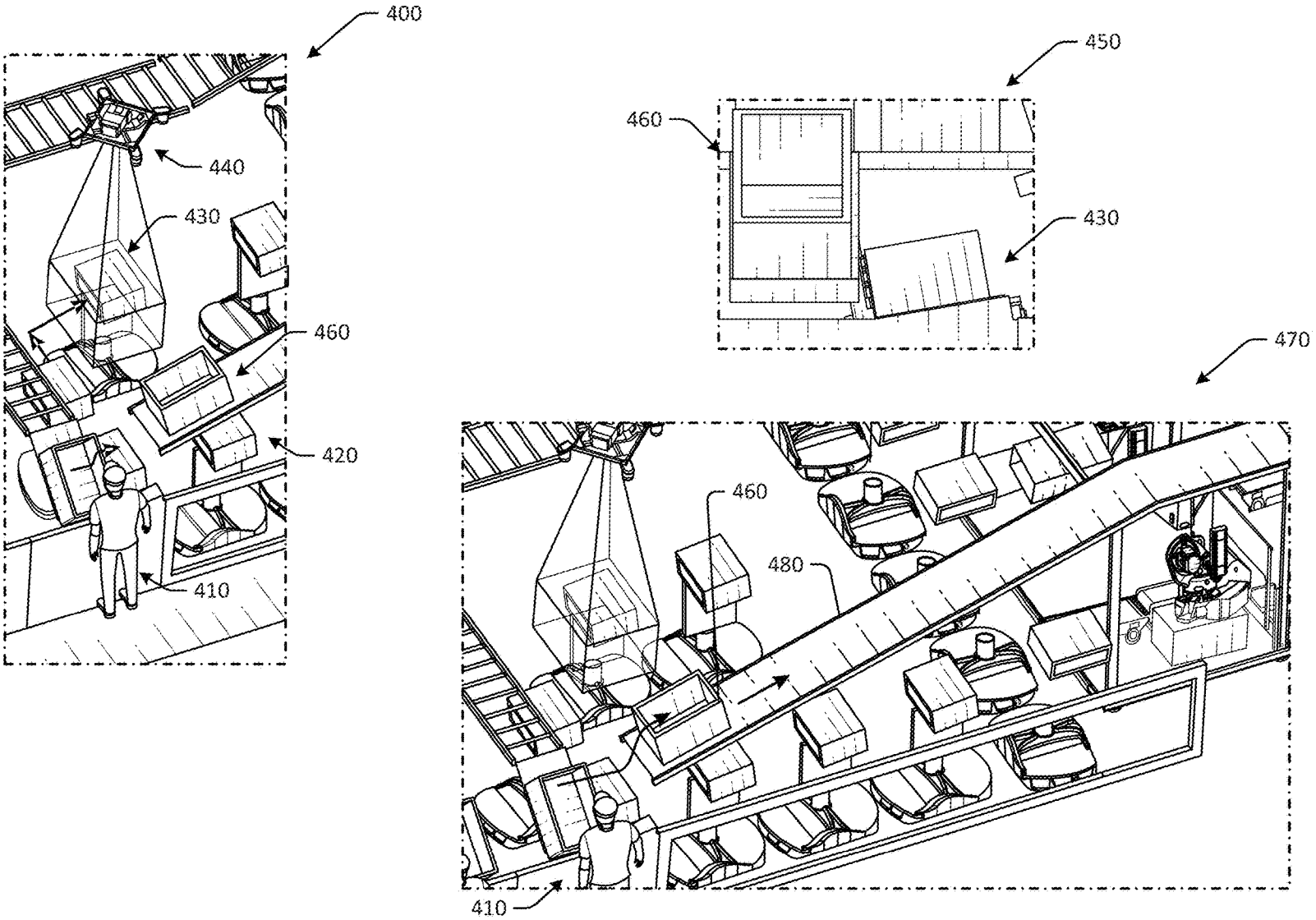
FIG. 4 is a schematic illustration of an example dimensioning system for items to be packed in custom-sized packages in accordance with one or more embodiments of the disclosure.

FIG. 4 is a schematic illustration of an example dimensioning system 400 for items to be packed in custom-sized packages in accordance with one or more embodiments of the disclosure. Other embodiments may include additional or fewer components. The illustration of FIG. 4 may not be to scale, and may not be illustrated to scale with respect to other figures. The portion of the system depicted in the example of FIG. 4 is for illustrative purposes only. Other embodiments may have different configurations. The components illustrated in FIG. 4 may be the same components discussed with respect to FIGS. 1-3.

The dimensioning system 400 may include one or more sensors 440 to dimension items 430 that are loaded onto drive robots 420. The sensors 440 may be disposed on an overhead assembly. The sensors 440 may be configured to determine one or more item dimensions, such as a height, length, and/or width of the item. The dimensions may be used to determine a corresponding size of package to generate for the item using the box generation machines. In some embodiments, item dimensions may be unknown prior to loading the item 430 onto the drive robot and dimensioning via the dimensioning system 400.

While the item is dimensioned and/or after the item is removed from the container 460, the empty container 460 may be placed on a downstream conveyor 480 to be reused by filling with another item. An operator 410 may handle the item 430 and/or empty container 460 in some instances. In other embodiments, the item and/or empty container may be handled using an automated system. As shown in side close-up view 450, the item 430 may be disposed at an angle when loaded onto the drive robot. The conveyor 480 may transport the empty container 460 downstream and out of the system as depicted in perspective view 470.

Figure 5:
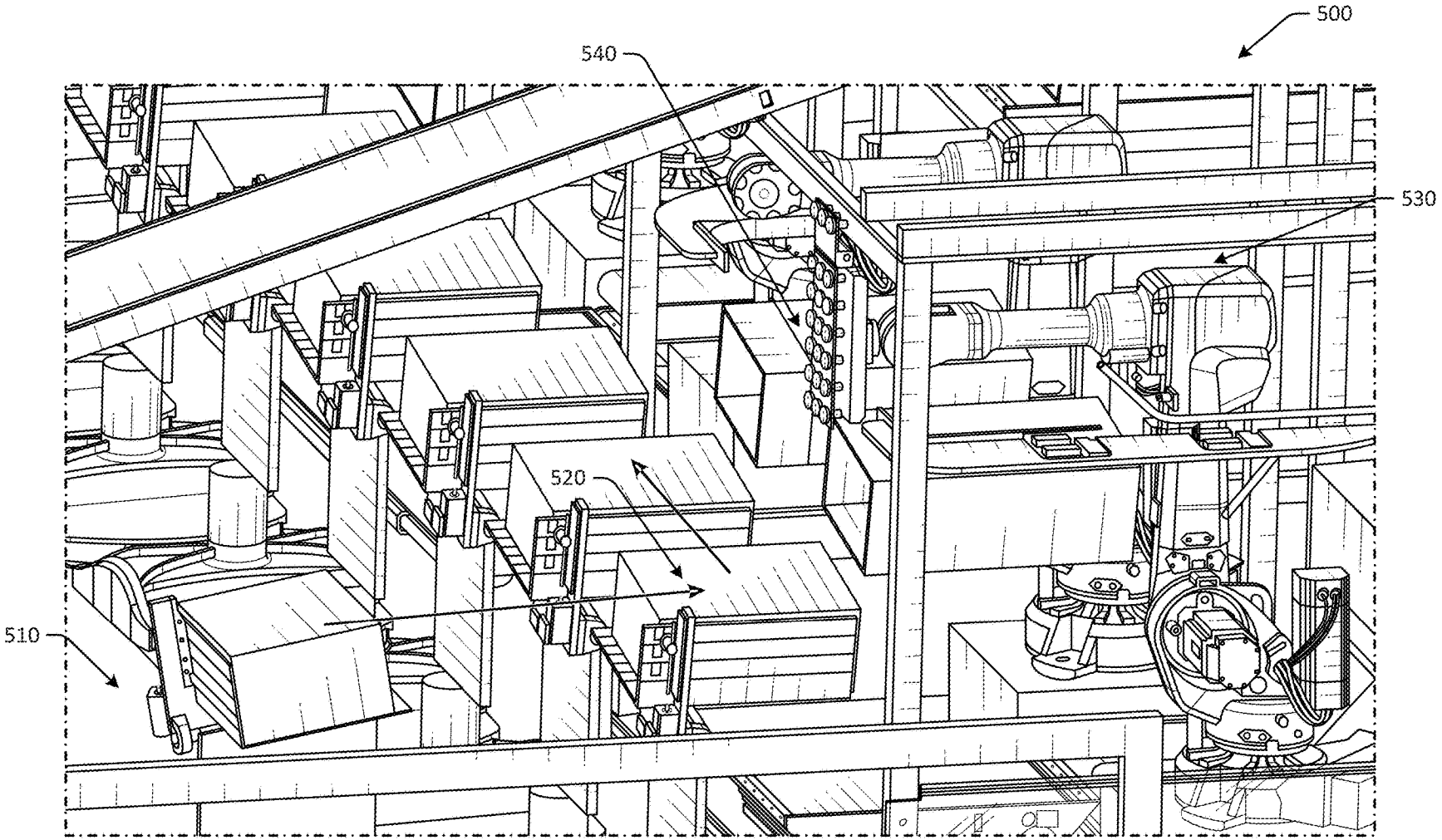
FIG. 5 is a schematic illustration of an example automated transport system for items to be packed in custom-sized packages in accordance with one or more embodiments of the disclosure.

FIG. 5 is a schematic illustration of an example automated transport system 500 for items to be packed in custom-sized packages in accordance with one or more embodiments of the disclosure. Other embodiments may include additional or fewer components. The illustrations of FIG. 5 may not be to scale, and may not be illustrated to scale with respect to other figures. The components illustrated in FIG. 5 may be the same as some of the components discussed with respect to FIGS. 1-4.

In FIG. 4, after the item is dimensioned, a controller of the system may determine that the first item 520 is to be routed to a first custom-sized package generation machine 530 based at least in part on the first dimension of the first item 520 and the first range of dimensions of the first custom-sized package generation machine 530, and may cause a first drive robot 510 to transport the first item 520 to the first custom-sized package generation machine 530. For example, the drive robot 510 may transport the first item 520 to the first custom-sized package generation machine 530. The first custom-sized package generation machine 530 may have one or more suction cup assemblies 540 that can be used to unflatten the custom-sized box and allow the item to be loaded from the drive robot into the custom-sized box.

In some instances, the assignment of the item to a particular custom-sized package generation machine may be dynamically modified, such as because of volume or load associated with a particular custom-sized package generation machine. For example, the controller may be configured to determine that a load on the first custom-sized package generation machine satisfies a reroute threshold (e.g., more than a certain number of items queued for the custom-sized package generation machine, more than a certain number of drive robots queued for the custom-sized package generation machine, a production time for boxes exceeding a threshold, downtime for the custom-sized package generation machine, remaining cardboard or paper supply at the custom-sized package generation machine, etc.). The controller may determine that the first dimension is within the second range of dimensions, such that the second custom-sized package generation machine can make a box for the item, even though it may be slightly larger than an optimal size in some embodiments. The controller may cause the first drive robot to transport the first item to the second custom-sized package generation machine instead of the first custom-sized package generation machine.

Figure 6:
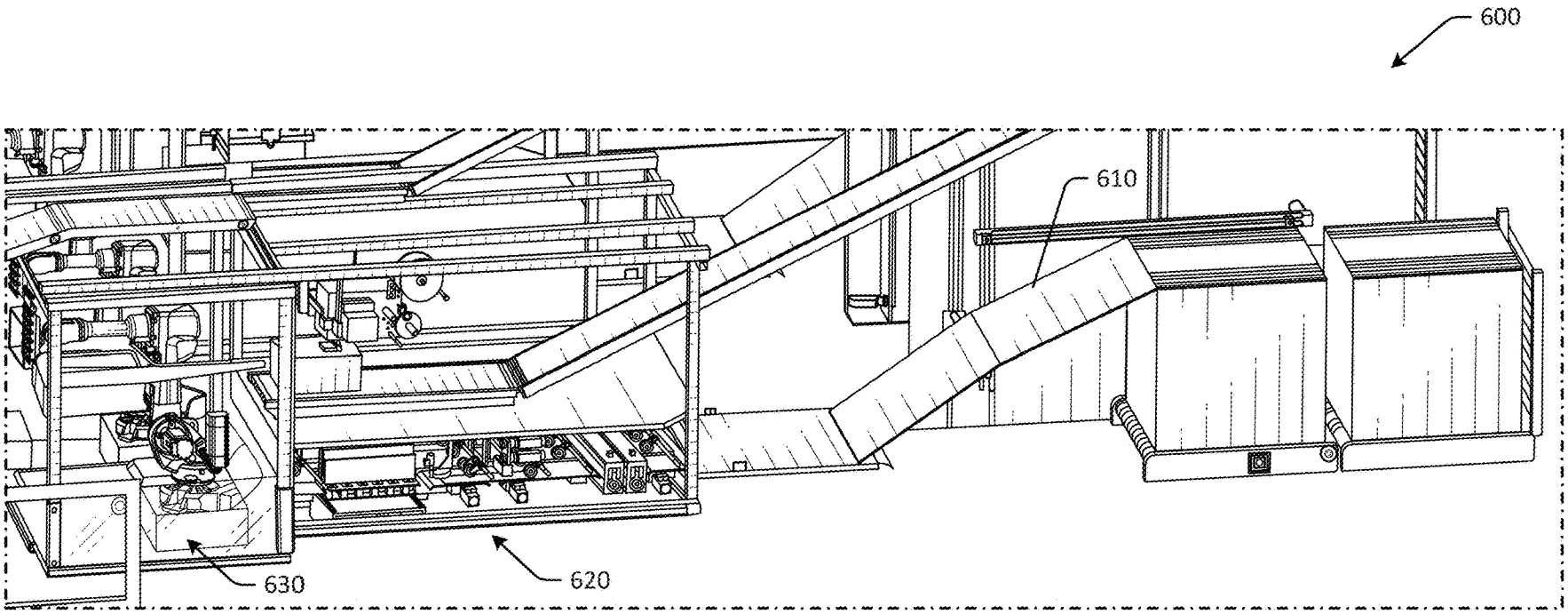
FIG. 6 is a schematic illustration of an example custom-sized package generation system in accordance with one or more embodiments of the disclosure.

FIG. 6 is a schematic illustration of an example custom-sized package generation system 600 in accordance with one or more embodiments of the disclosure. Other embodiments may include additional or fewer components. The illustrations of FIG. 6 may not be to scale, and may not be illustrated to scale with respect to other figures. The components illustrated in FIG. 6 may be the same as some of the components discussed with respect to FIGS. 1-5.

In FIG. 6, the custom-sized package generation system 600 may generate a custom-sized box for the item that is to be packed. The custom-sized package generation system 600 may form boxes using cardboard or other paper products 610. The custom-sized package generation system 600 may produce an empty cardboard box that can be erected using a robotic arm 630 and/or the suction assemblies discussed with respect to FIG. 5. The custom-sized package generation system 600 may include hardware 620 that allows the custom-sized package generation system 600 to be a standalone unit that can be configured to generate boxes of different ranges of dimensions.

In some embodiments, the custom-sized package generation system 600 may be reconfigured to produce the same range of dimensions as another custom-sized package generation system. For example, if a large number of the same dimension products are upstream and will be inducted by the system (e.g., a large number of smartphones, etc.), the controller may determine that a number of upstream items having dimensions in the first range of dimensions routed to the system satisfies a system reconfiguration threshold (e.g., a certain number of items over a certain time period, etc.). The controller may cause a second custom-sized package generation machine to be reconfigured to generate boxes having the first range of dimensions, or the same dimensions as the custom-sized package generation system 600.

Figure 7:
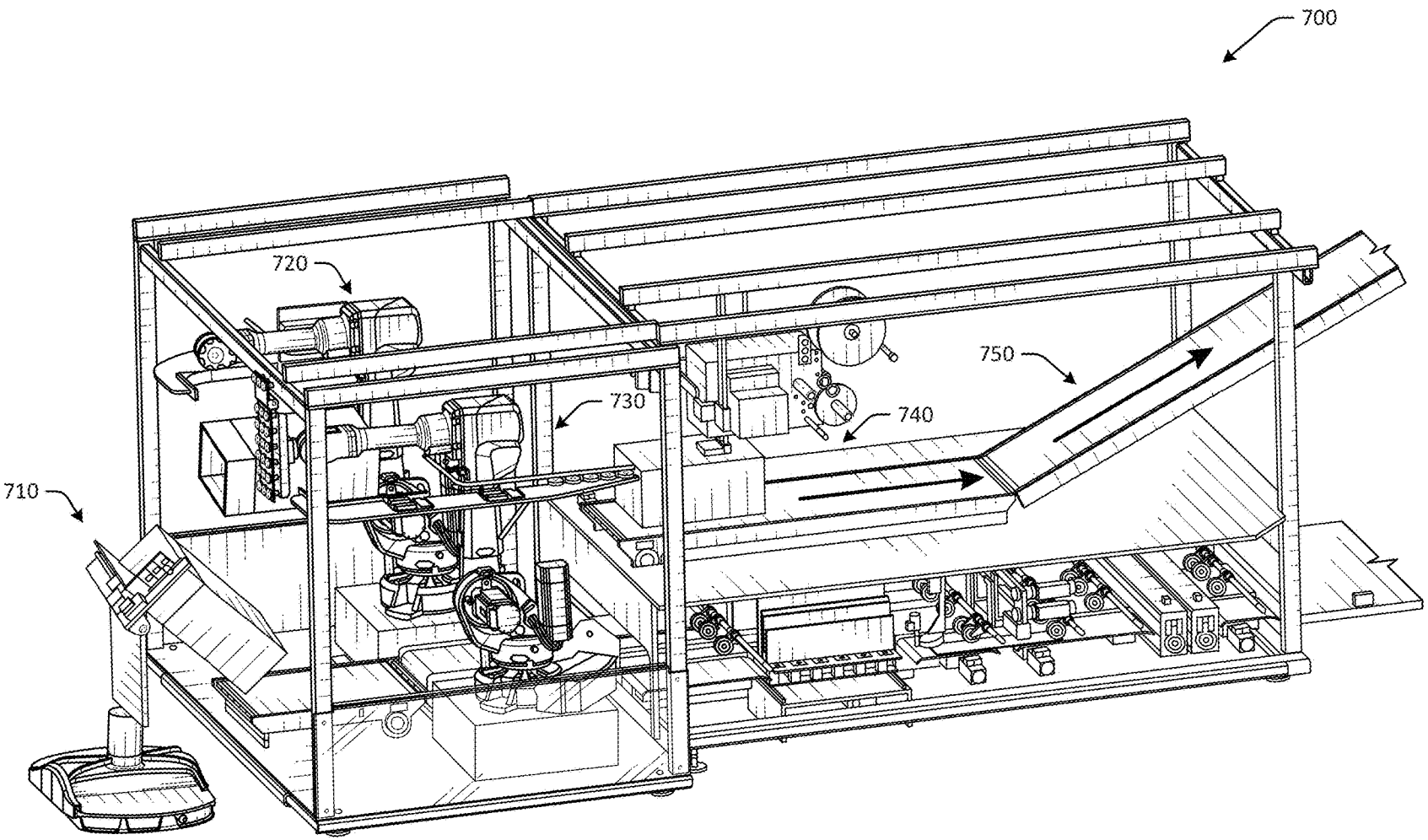
FIG. 7 is a schematic illustration of an example custom-sized package being loaded and sealed in accordance with one or more embodiments of the disclosure.

FIG. 7 is a schematic illustration of an example custom-sized package being loaded and sealed in accordance with one or more embodiments of the disclosure. Other embodiments may include additional or fewer components. The illustrations of FIG. 7 may not be to scale, and may not be illustrated to scale with respect to other figures. The components illustrated in FIG. 7 may be the same as some of the components discussed with respect to FIGS. 1-6.

In FIG. 7, an item 710 may be loaded from a drive robot into a custom-sized package that is supported by a robotic manipulator 720, 730. The empty box may be lifted toward the drive robot and the item using one of the robotic manipulators 720, 730. For example, the controller may cause a robotic manipulator to retrieve a flattened custom-sized box from a custom-sized package generation machine. The robotic manipulator may use suction to lift the custom-sized box and unflatten it, so as to form a tunnel. The controller may cause a first end of the custom-sized box to be sealed. For example, the controller may cause the robotic manipulator to move one end of the custom-sized box along a folder and/or sealer (e.g., gluer, taper, etc.) to seal one end of the custom-sized box. The custom-sized box may therefore be ready to receive one or more items for packing.

The item may be loaded using gravity, as described below. The filled or loaded box may be closed using one of the robotic manipulators 720, 730 (e.g., taped, glued, or otherwise folded and sealed, etc.). The packed box may be placed on an outbound conveyor 740 by one of the robotic manipulators 720, 730. The outbound conveyor 740 may direct the package to a downstream loading dock 750 for shipment.

To load items into the custom-sized box, the drive robots may have item loading components used to support one or more items for shipment during transport through a facility. The item loading component may be configured to tilt in one or more directions so as to facilitate loading of the item(s) from the item loading component into a custom-sized package. The custom-sized package may be supported by a robotic manipulator. In some embodiments, the item loading component may be coupled to a drive robot that is configured to support the item loading component via a mount. The mount may be configured to tilt the item loading component in one or more directions, such as a lateral direction to allow an item supported by the item loading component to slide or fall off the item loading component. In some embodiments, the mount may be configured to tilt the item loading component in a rearwards and/or forwards direction, such that items loaded on the item loading component are stable during movement of the drive robot. In other embodiments, the item loading component may be coupled to a different device than a drive robot and may be in a static position. The mount may be coupled to a drive robot configured to transport the item loading component, where the mount can be configured to tilt the item loading component in one or both lateral directions and/or a rearwards and forwards direction.

The controller may cause the V-shaped component to tilt toward the custom-sized box while the custom-sized box is grasped by the robotic manipulator. Gravity may cause the item to be transferred from the V-shaped component into the custom-sized box. The controller may cause a second end of the custom-sized box to be sealed. Once the item is loaded into the custom-sized box, the robotic manipulator may take the loaded item to the folder and/or sealer for sealing of the second end of the custom-sized box. The custom-sized package may then be placed on a downstream conveyor for shipment.

One or more operations of the methods, process flows, or use cases of FIGS. 1-7 may have been described above as being performed by a user device, or more specifically, by one or more program module(s), applications, or the like executing on a device. It should be appreciated, however, that any of the operations of the methods, process flows, or use cases of FIGS. 1-7 may be performed, at least in part, in a distributed manner by one or more other devices, or more specifically, by one or more program module(s), applications, or the like executing on such devices. In addition, it should be appreciated that processing performed in response to the execution of computer-executable instructions provided as part of an application, program module, or the like may be interchangeably described herein as being performed by the application or the program module itself or by a device on which the application, program module, or the like is executing. While the operations of the methods, process flows, or use cases of FIGS. 1-7 may be described in the context of the illustrative devices, it should be appreciated that such operations may be implemented in connection with numerous other device configurations.

The operations described and depicted in the illustrative methods, process flows, and use cases of FIGS. 1-7 may be carried out or performed in any suitable order, such as the depicted orders, as desired in various example embodiments of the disclosure. Additionally, in certain example embodiments, at least a portion of the operations may be carried out in parallel. Furthermore, in certain example embodiments, less, more, or different operations than those depicted in FIGS. 1-7 may be performed.

Although specific embodiments of the disclosure have been described, one of ordinary skill in the art will recognize that numerous other modifications and alternative embodiments are within the scope of the disclosure. For example, any of the functionality and/or processing capabilities described with respect to a particular device or component may be performed by any other device or component. Further, while various illustrative implementations and architectures have been described in accordance with embodiments of the disclosure, one of ordinary skill in the art will appreciate that numerous other modifications to the illustrative implementations and architectures described herein are also within the scope of this disclosure.

Certain aspects of the disclosure are described above with reference to block and flow diagrams of systems, methods, apparatuses, and/or computer program products according to example embodiments. It will be understood that one or more blocks of the block diagrams and flow diagrams, and combinations of blocks in the block diagrams and the flow diagrams, respectively, may be implemented by the execution of computer-executable program instructions. Likewise, some blocks of the block diagrams and flow diagrams may not necessarily need to be performed in the order presented, or may not necessarily need to be performed at all, according to some embodiments. Further, additional components and/or operations beyond those depicted in blocks of the block and/or flow diagrams may be present in certain embodiments.

Accordingly, blocks of the block diagrams and flow diagrams support combinations of means for performing the specified functions, combinations of elements or steps for performing the specified functions, and program instruction means for performing the specified functions. It will also be understood that each block of the block diagrams and flow diagrams, and combinations of blocks in the block diagrams and flow diagrams, may be implemented by special-purpose, hardware-based computer systems that perform the specified functions, elements or steps, or combinations of special-purpose hardware and computer instructions.

Illustrative Computer Architecture

Figure 8:
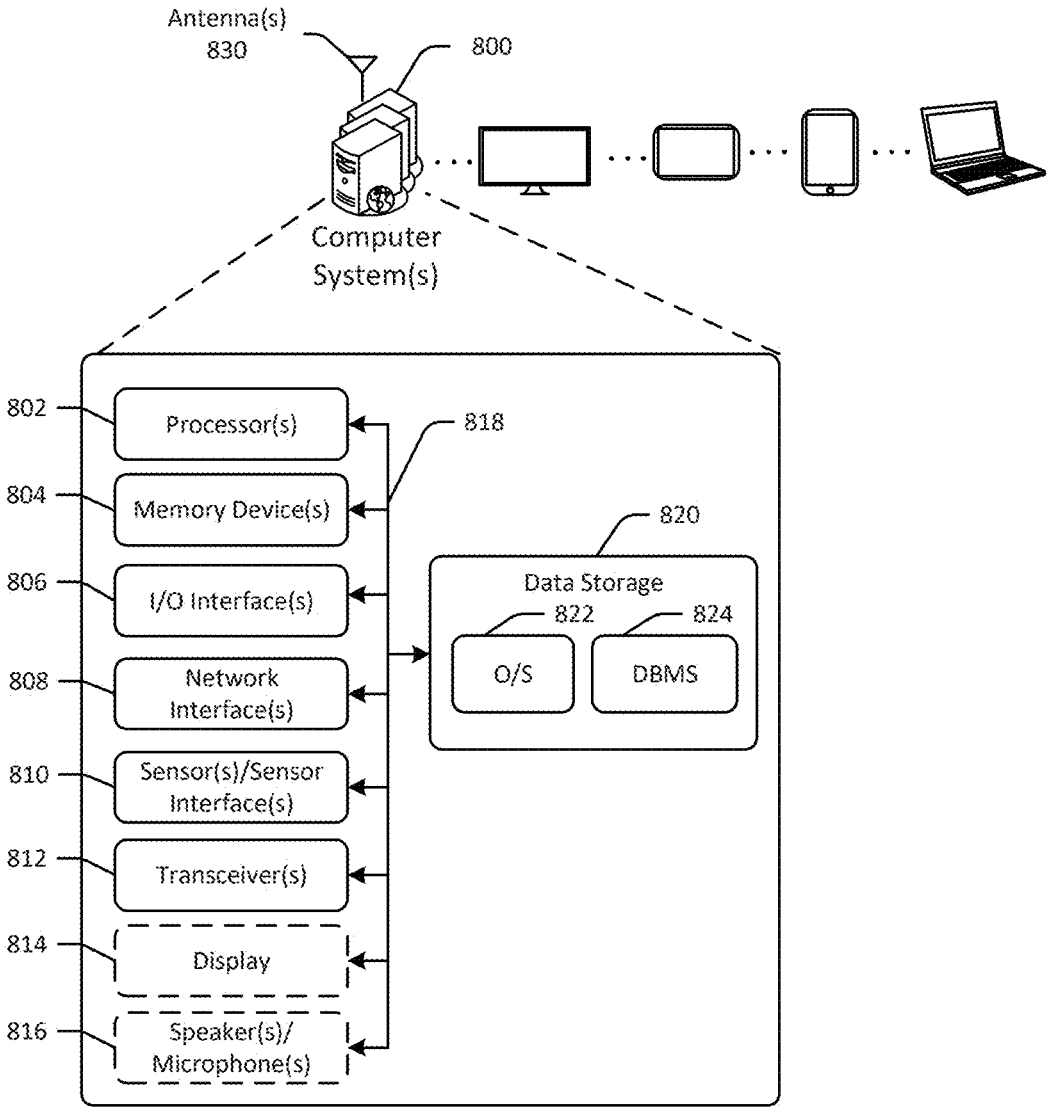
FIG. 8 schematically illustrates an example architecture of a computer system associated with a custom container shipping system in accordance with one or more embodiments of the disclosure.

FIG. 8 is a schematic block diagram of one or more illustrative computer system(s) 800 associated with a custom container generation system in accordance with one or more example embodiments of the disclosure. The computer system(s) 800 may include any suitable computing device including, but not limited to, a server system, a voice interaction device, a mobile device such as a smartphone, a tablet, an e-reader, a wearable device, or the like; a desktop computer; a laptop computer; a content streaming device; or the like. The computer system(s) 800 may correspond to an illustrative device configuration for the controller(s) of FIGS. 1-7. For example, the computer system(s) 800 may be a controller and may control one or more aspects of the custom container generation and/or shipping systems described in FIGS. 1-7.

The computer system(s) 800 may be configured to communicate with one or more servers, user devices, or the like. The computer system(s) 800 may be configured to control operation of one or more components of the custom container generation systems, such as determining item loading or drive robot operations, causing certain amounts of materials to be dispensed for package formation, and so forth.

The computer system(s) 800 may be configured to communicate via one or more networks. Such network(s) may include, but are not limited to, any one or more different types of communications networks such as, for example, cable networks, public networks (e.g., the Internet), private networks (e.g., frame-relay networks), wireless networks, cellular networks, telephone networks (e.g., a public switched telephone network), or any other suitable private or public packet-switched or circuit-switched networks. Further, such network(s) may have any suitable communication range associated therewith and may include, for example, global networks (e.g., the Internet), metropolitan area networks (MANs), wide area networks (WANs), local area networks (LANs), or personal area networks (PANs). In addition, such network(s) may include communication links and associated networking devices (e.g., link-layer switches, routers, etc.) for transmitting network traffic over any suitable type of medium including, but not limited to, coaxial cable, twisted-pair wire (e.g., twisted-pair copper wire), optical fiber, a hybrid fiber-coaxial (HFC) medium, a microwave medium, a radio frequency communication medium, a satellite communication medium, or any combination thereof.

In an illustrative configuration, the computer system(s) 800 may include one or more processors (processor(s)) 802, one or more memory devices 804 (also referred to herein as memory 804), one or more input/output (I/O) interface(s) 806, one or more network interface(s) 808, one or more sensor(s) or sensor interface(s) 810, one or more transceiver(s) 812, one or more optional display(s) 814, one or more optional microphone(s) 816, and data storage 820. The computer system(s) 800 may further include one or more bus(es) 818 that functionally couple various components of the computer system(s) 800. The computer system(s) 800 may further include one or more antenna(s) 830 that may include, without limitation, a cellular antenna for transmitting or receiving signals to/from a cellular network infrastructure, an antenna for transmitting or receiving Wi-Fi signals to/from an access point (AP), a Global Navigation Satellite System (GNSS) antenna for receiving GNSS signals from a GNSS satellite, a Bluetooth antenna for transmitting or receiving Bluetooth signals, a Near Field Communication (NFC) antenna for transmitting or receiving NFC signals, and so forth. These various components will be described in more detail hereinafter.

The bus(es) 818 may include at least one of a system bus, a memory bus, an address bus, or a message bus, and may permit the exchange of information (e.g., data (including computer-executable code), signaling, etc.) between various components of the computer system(s) 800. The bus(es) 818 may include, without limitation, a memory bus or a memory controller, a peripheral bus, an accelerated graphics port, and so forth. The bus(es) 818 may be associated with any suitable bus architecture including, without limitation, an Industry Standard Architecture (ISA), a Micro Channel Architecture (MCA), an Enhanced ISA (EISA), a Video Electronics Standards Association (VESA) architecture, an Accelerated Graphics Port (AGP) architecture, a Peripheral Component Interconnect (PCI) architecture, a PCI-Express architecture, a Personal Computer Memory Card International Association (PCMCIA) architecture, a Universal Serial Bus (USB) architecture, and so forth.

The memory 804 of the computer system(s) 800 may include volatile memory (memory that maintains its state when supplied with power) such as random access memory (RAM) and/or non-volatile memory (memory that maintains its state even when not supplied with power) such as read-only memory (ROM), flash memory, ferroelectric RAM (FRAM), and so forth. Persistent data storage, as that term is used herein, may include non-volatile memory. In certain example embodiments, volatile memory may enable faster read/write access than non-volatile memory. However, in certain other example embodiments, certain types of non-volatile memory (e.g., FRAM) may enable faster read/write access than certain types of volatile memory.

In various implementations, the memory 804 may include multiple different types of memory such as various types of static random access memory (SRAM), various types of dynamic random access memory (DRAM), various types of unalterable ROM, and/or writeable variants of ROM such as electrically erasable programmable read-only memory (EEPROM), flash memory, and so forth. The memory 804 may include main memory as well as various forms of cache memory such as instruction cache(s), data cache(s), translation lookaside buffer(s) (TLBs), and so forth. Further, cache memory such as a data cache may be a multi-level cache organized as a hierarchy of one or more cache levels (L1, L2, etc.).

The data storage 820 may include removable storage and/or non-removable storage including, but not limited to, magnetic storage, optical disk storage, and/or tape storage. The data storage 820 may provide non-volatile storage of computer-executable instructions and other data. The memory 804 and the data storage 820, removable and/or non-removable, are examples of computer-readable storage media (CRSM) as that term is used herein.

The data storage 820 may store computer-executable code, instructions, or the like that may be loadable into the memory 804 and executable by the processor(s) 802 to cause the processor(s) 802 to perform or initiate various operations. The data storage 820 may additionally store data that may be copied to the memory 804 for use by the processor(s) 802 during the execution of the computer-executable instructions. Moreover, output data generated as a result of execution of the computer-executable instructions by the processor(s) 802 may be stored initially in the memory 804, and may ultimately be copied to the data storage 820 for non-volatile storage.

More specifically, the data storage 820 may store one or more operating systems (O/S) 822; one or more database management systems (DBMS) 824; and one or more program module(s), applications, engines, computer-executable code, scripts, or the like. Some or all of these module(s) may be sub-module(s). Any of the components depicted as being stored in the data storage 820 may include any combination of software, firmware, and/or hardware. The software and/or firmware may include computer-executable code, instructions, or the like that may be loaded into the memory 804 for execution by one or more of the processor(s) 802. Any of the components depicted as being stored in the data storage 820 may support functionality described in reference to corresponding components named earlier in this disclosure.

The data storage 820 may further store various types of data utilized by the components of the computer system(s) 800. Any data stored in the data storage 820 may be loaded into the memory 804 for use by the processor(s) 802 in executing computer-executable code. In addition, any data depicted as being stored in the data storage 820 may potentially be stored in one or more datastore(s) and may be accessed via the DBMS 824 and loaded in the memory 804 for use by the processor(s) 802 in executing computer-executable code. The datastore(s) may include, but are not limited to, databases (e.g., relational, object-oriented, etc.), file systems, flat files, distributed datastores in which data is stored on more than one node of a computer network, peer-to-peer network datastores, or the like.

The processor(s) 802 may be configured to access the memory 804 and execute the computer-executable instructions loaded therein. For example, the processor(s) 802 may be configured to execute the computer-executable instructions of the various program module(s), applications, engines, or the like of the computer system(s) 800 to cause or facilitate various operations to be performed in accordance with one or more embodiments of the disclosure. The processor(s) 802 may include any suitable processing unit capable of accepting data as input, processing the input data in accordance with stored computer-executable instructions, and generating output data. The processor(s) 802 may include any type of suitable processing unit including, but not limited to, a central processing unit, a microprocessor, a Reduced Instruction Set Computer (RISC) microprocessor, a Complex Instruction Set Computer (CISC) microprocessor, a microcontroller, an Application Specific Integrated Circuit (ASIC), a Field-Programmable Gate Array (FPGA), a System-on-a-Chip (SoC), a digital signal processor (DSP), and so forth. Further, the processor(s) 802 may have any suitable microarchitecture design that includes any number of constituent components such as, for example, registers, multiplexers, arithmetic logic units, cache controllers for controlling read/write operations to cache memory, branch predictors, or the like. The microarchitecture design of the processor(s) 802 may be capable of supporting any of a variety of instruction sets.

Referring now to other illustrative components depicted as being stored in the data storage 820, the O/S 822 may be loaded from the data storage 820 into the memory 804 and may provide an interface between other application software executing on the computer system(s) 800 and the hardware resources of the computer system(s) 800. More specifically, the O/S 822 may include a set of computer-executable instructions for managing the hardware resources of the computer system(s) 800 and for providing common services to other application programs (e.g., managing memory allocation among various application programs). In certain example embodiments, the O/S 822 may control execution of the other program module(s). The O/S 822 may include any operating system now known or which may be developed in the future including, but not limited to, any server operating system, any mainframe operating system, or any other proprietary or non-proprietary operating system.

The DBMS 824 may be loaded into the memory 804 and may support functionality for accessing, retrieving, storing, and/or manipulating data stored in the memory 804 and/or data stored in the data storage 820. The DBMS 824 may use any of a variety of database models (e.g., relational model, object model, etc.) and may support any of a variety of query languages. The DBMS 824 may access data represented in one or more data schemas and stored in any suitable data repository including, but not limited to, databases (e.g., relational, object-oriented, etc.), file systems, flat files, distributed datastores in which data is stored on more than one node of a computer network, peer-to-peer network datastores, or the like. In those example embodiments in which the computer system(s) 800 is a mobile device, the DBMS 824 may be any suitable lightweight DBMS optimized for performance on a mobile device.

Referring now to other illustrative components of the computer system(s) 800, the input/output (I/O) interface(s) 806 may facilitate the receipt of input information by the computer system(s) 800 from one or more I/O devices as well as the output of information from the computer system(s) 800 to the one or more I/O devices. The I/O devices may include any of a variety of components such as a display or display screen having a touch surface or touchscreen; an audio output device for producing sound, such as a speaker; an audio capture device, such as a microphone; an image and/or video capture device, such as a camera; a haptic unit; and so forth. Any of these components may be integrated into the computer system(s) 800 or may be separate. The I/O devices may further include, for example, any number of peripheral devices such as data storage devices, printing devices, and so forth.

The I/O interface(s) 806 may also include an interface for an external peripheral device connection such as universal serial bus (USB), Fire Wire, Thunderbolt, Ethernet port or other connection protocol that may connect to one or more networks. The I/O interface(s) 806 may also include a connection to one or more of the antenna(s) 830 to connect to one or more networks via a wireless local area network (WLAN) (such as Wi-Fi) radio, Bluetooth, ZigBee, and/or a wireless network radio, such as a radio capable of communication with a wireless communication network such as a Long Term Evolution (LTE) network, WiMAX network, 3G network, a ZigBee network, etc.

The computer system(s) 800 may further include one or more network interface(s) 808 via which the computer system(s) 800 may communicate with any of a variety of other systems, platforms, networks, devices, and so forth. The network interface(s) 808 may enable communication, for example, with one or more wireless routers, one or more host servers, one or more web servers, and the like via one or more networks.

The antenna(s) 830 may include any suitable type of antenna depending, for example, on the communications protocols used to transmit or receive signals via the antenna(s) 830. Non-limiting examples of suitable antenna(s) may include directional antenna(s), non-directional antenna(s), dipole antenna(s), folded dipole antenna(s), patch antenna(s), multiple-input multiple-output (MIMO) antenna(s), or the like. The antenna(s) 830 may be communicatively coupled to one or more transceivers 812 or radio components to which or from which signals may be transmitted or received.

As previously described, the antenna(s) 830 may include a cellular antenna configured to transmit or receive signals in accordance with established standards and protocols, such as Global System for Mobile Communications (GSM), 3G standards (e.g., Universal Mobile Telecommunications System (UMTS), Wideband Code Division Multiple Access (W-CDMA), CDMA2000, etc.), 4G standards (e.g., Long-Term Evolution (LTE), WiMax, etc.), direct satellite communications, or the like.

The antenna(s) 830 may additionally, or alternatively, include a Wi-Fi antenna configured to transmit or receive signals in accordance with established standards and protocols, such as the IEEE 802.11 family of standards, including via 2.4 GHz channels (e.g., 802.11b, 802.11g, 802.11n), 5 GHz channels (e.g., 802.11n, 802.11ac), or 60 GHz channels (e.g., 802.11ad). In alternative example embodiments, the antenna(s) 830 may be configured to transmit or receive radio frequency signals within any suitable frequency range forming part of the unlicensed portion of the radio spectrum.

The antenna(s) 830 may additionally, or alternatively, include a GNSS antenna configured to receive GNSS signals from three or more GNSS satellites carrying time-position information to triangulate a position therefrom. Such a GNSS antenna may be configured to receive GNSS signals from any current or planned GNSS such as, for example, the Global Positioning System (GPS), the GLONASS System, the Compass Navigation System, the Galileo System, or the Indian Regional Navigational System.

The transceiver(s) 812 may include any suitable radio component(s) for-in cooperation with the antenna(s) 830—transmitting or receiving radio frequency (RF) signals in the bandwidth and/or channels corresponding to the communications protocols utilized by the computer system(s) 800 to communicate with other devices. The transceiver(s) 812 may include hardware, software, and/or firmware for modulating, transmitting, or receiving-potentially in cooperation with any of antenna(s) 830—communications signals according to any of the communications protocols discussed above including, but not limited to, one or more Wi-Fi and/or Wi-Fi direct protocols, as standardized by the IEEE 802.11 standards, one or more non-Wi-Fi protocols, or one or more cellular communications protocols or standards. The transceiver(s) 812 may further include hardware, firmware, or software for receiving GNSS signals. The transceiver(s) 812 may include any known receiver and baseband suitable for communicating via the communications protocols utilized by the computer system(s) 800. The transceiver(s) 812 may further include a low noise amplifier (LNA), additional signal amplifiers, an analog-to-digital (A/D) converter, one or more buffers, a digital baseband, or the like.

The sensor(s)/sensor interface(s) 810 may include or may be capable of interfacing with any suitable type of sensing device such as, for example, inertial sensors, force sensors, thermal sensors, photocells, and so forth. Example types of inertial sensors may include accelerometers (e.g., MEMS-based accelerometers), gyroscopes, and so forth.

The optional display(s) 814 may be configured to output light and/or render content. The optional speaker(s)/microphone(s) 816 may be any device configured to receive analog sound input or voice data.

It should be appreciated that the program module(s), applications, computer-executable instructions, code, or the like depicted in FIG. 8 as being stored in the data storage 820 are merely illustrative and not exhaustive and that processing described as being supported by any particular module may alternatively be distributed across multiple module(s) or performed by a different module. In addition, various program module(s), script(s), plug-in(s), Application Programming Interface(s) (API(s)), or any other suitable computer-executable code hosted locally on the computer system(s) 800, and/or hosted on other computing device(s) accessible via one or more networks, may be provided to support functionality provided by the program module(s), applications, or computer-executable code depicted in FIG. 8 and/or additional or alternate functionality. Further, functionality may be modularized differently such that processing described as being supported collectively by the collection of program module(s) depicted in FIG. 8 may be performed by a fewer or greater number of module(s), or functionality described as being supported by any particular module may be supported, at least in part, by another module. In addition, program module(s) that support the functionality described herein may form part of one or more applications executable across any number of systems or devices in accordance with any suitable computing model such as, for example, a client-server model, a peer-to-peer model, and so forth. In addition, any of the functionality described as being supported by any of the program module(s) depicted in FIG. 8 may be implemented, at least partially, in hardware and/or firmware across any number of devices.

It should further be appreciated that the computer system(s) 800 may include alternate and/or additional hardware, software, or firmware components beyond those described or depicted without departing from the scope of the disclosure. More particularly, it should be appreciated that software, firmware, or hardware components depicted as forming part of the computer system(s) 800 are merely illustrative and that some components may not be present or additional components may be provided in various embodiments. While various illustrative program module(s) have been depicted and described as software module(s) stored in the data storage 820, it should be appreciated that functionality described as being supported by the program module(s) may be enabled by any combination of hardware, software, and/or firmware. It should further be appreciated that each of the above-mentioned module(s) may, in various embodiments, represent a logical partitioning of supported functionality. This logical partitioning is depicted for ease of explanation of the functionality and may not be representative of the structure of software, hardware, and/or firmware for implementing the functionality. Accordingly, it should be appreciated that functionality described as being provided by a particular module may, in various embodiments, be provided at least in part by one or more other module(s). Further, one or more depicted module(s) may not be present in certain embodiments, while in other embodiments, additional module(s) not depicted may be present and may support at least a portion of the described functionality and/or additional functionality. Moreover, while certain module(s) may be depicted and described as sub-module(s) of another module, in certain embodiments, such module(s) may be provided as independent module(s) or as sub-module(s) of other module(s).

Program module(s), applications, or the like disclosed herein may include one or more software components including, for example, software objects, methods, data structures, or the like. Each such software component may include computer-executable instructions that, responsive to execution, cause at least a portion of the functionality described herein (e.g., one or more operations of the illustrative methods described herein) to be performed.

A software component may be coded in any of a variety of programming languages. An illustrative programming language may be a lower-level programming language such as an assembly language associated with a particular hardware architecture and/or operating system platform. A software component comprising assembly language instructions may require conversion into executable machine code by an assembler prior to execution by the hardware architecture and/or platform.

Another example programming language may be a higher-level programming language that may be portable across multiple architectures. A software component comprising higher-level programming language instructions may require conversion to an intermediate representation by an interpreter or a compiler prior to execution.

Other examples of programming languages include, but are not limited to, a macro language, a shell or command language, a job control language, a script language, a database query or search language, or a report writing language. In one or more example embodiments, a software component comprising instructions in one of the foregoing examples of programming languages may be executed directly by an operating system or other software component without having to be first transformed into another form.

A software component may be stored as a file or other data storage construct. Software components of a similar type or functionally related may be stored together such as, for example, in a particular directory, folder, or library. Software components may be static (e.g., pre-established or fixed) or dynamic (e.g., created or modified at the time of execution).

Software components may invoke or be invoked by other software components through any of a wide variety of mechanisms. Invoked or invoking software components may comprise other custom-developed application software, operating system functionality (e.g., device drivers, data storage (e.g., file management) routines, other common routines and services, etc.), or third-party software components (e.g., middleware, encryption, or other security software, database management software, file transfer or other network communication software, mathematical or statistical software, image processing software, and format translation software).

Software components associated with a particular solution or system may reside and be executed on a single platform or may be distributed across multiple platforms. The multiple platforms may be associated with more than one hardware vendor, underlying chip technology, or operating system. Furthermore, software components associated with a particular solution or system may be initially written in one or more programming languages, but may invoke software components written in another programming language.

Computer-executable program instructions may be loaded onto a special-purpose computer or other particular machine, a processor, or other programmable data processing apparatus to produce a particular machine, such that execution of the instructions on the computer, processor, or other programmable data processing apparatus causes one or more functions or operations specified in the flow diagrams to be performed. These computer program instructions may also be stored in a computer-readable storage medium (CRSM) that upon execution may direct a computer or other programmable data processing apparatus to function in a particular manner, such that the instructions stored in the computer-readable storage medium produce an article of manufacture including instruction means that implement one or more functions or operations specified in the flow diagrams. The computer program instructions may also be loaded onto a computer or other programmable data processing apparatus to cause a series of operational elements or steps to be performed on the computer or other programmable apparatus to produce a computer-implemented process.

Additional types of CRSM that may be present in any of the devices described herein may include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile disc (DVD) or other optical storage, magnetic cassettes, magnetic tape, magnetic disk storage or other magnetic storage devices, or any other medium which can be used to store the information and which can be accessed. Combinations of any of the above are also included within the scope of CRSM. Alternatively, computer-readable communication media (CRCM) may include computer-readable instructions, program module(s), or other data transmitted within a data signal, such as a carrier wave, or other transmission. However, as used herein, CRSM does not include CRCM.

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

That which is claimed is:

1. An item packing facility comprising:

an item induction system configured to induct a first item and a second item for packing into custom-sized packages;

a first custom-sized package generation machine configured to generate packaging having a first range of dimensions;

a second custom-sized package generation machine configured to generate packaging having a second range of dimensions;

a first independent transport robot configured to transport the first item to at least one of the first and second custom-sized package generation machines; and a second independent transport robot configured to transport the second item to at least one of the first and second custom-sized package generation machines;

wherein the first custom-sized package generation machine and the second custom-sized package generation machine are decoupled from the induction system.

2. The item packing facility of claim 1, further comprising:

a controller configured to:

cause the first item to be loaded onto the first independent transport robot at the item induction system;

determine a first dimension of the first item;

determine that the first item is to be routed to the first custom-sized package generation machine based at least in part on the first dimension of the first item and the first range of dimensions of the first custom-sized package generation machine; and cause the first independent transport robot to transport the first item to the first custom-sized package generation machine.

3. The item packing facility of claim 1, further comprising:

a third custom-sized package generation machine configured to generate packaging having a third range of dimensions; and a fourth custom-sized package generation machine configured to generate packaging having a fourth range of dimensions;

wherein the first range of dimensions partially overlaps the second range of dimensions, and the third range of dimensions partially overlaps the fourth range of dimensions.

4. The item packing facility of claim 1, further comprising:

a first conveyor configured to transport the first item to the first independent transport robot via a first container;

a second conveyor to transport the first container downstream; and a sensor configured to determine at least one dimension of the first item while the first item is disposed on the first independent transport robot.

5. A system for packing items into custom-sized packages, the system comprising:

a first custom-sized package generation machine configured to generate packaging having a first range of dimensions;

a second custom-sized package generation machine configured to generate packaging having a second range of dimensions; and a first independent transport robot configured to transport items to at least one of the first and second custom-sized package generation machines;

wherein the first custom-sized package generation machine and the second custom-sized package generation machine are decoupled from an item induction portion of the system.

6. The system of claim 5, further comprising:

a controller configured to:

cause a first item to be loaded onto the first independent transport robot at the item induction portion;

determine a first dimension of the first item;

determine that the first item is to be routed to the first custom-sized package generation machine based at least in part on the first dimension and the first range of dimensions; and cause the first independent transport robot to transport the first item to the first custom-sized package generation machine.

7. The system of claim 6, wherein the first dimension is unknown prior to loading the first item onto the first independent transport robot.

8. The system of claim 6, wherein the controller is further configured to:

determine that a load on the first custom-sized package generation machine satisfies a reroute threshold;

determine that the first dimension is within the second range of dimensions; and cause the first independent transport robot to transport the first item to the second custom-sized package generation machine instead of the first custom-sized package generation machine.

9. The system of claim 6, wherein the controller is further configured to:

determine that a number of upstream items having dimensions in the first range of dimensions routed to the system satisfies a system reconfiguration threshold;

cause the second custom-sized package generation machine to be reconfigured to generate packaging having the first range of dimensions.

10. The system of claim 5, further comprising:

a second independent transport robot configured to transport items to both the first and second custom-sized package generation machines;

wherein the first independent transport robot is configured to transport items to both the first and second custom-sized package generation machines.

11. The system of claim 5, further comprising:

a first conveyor configured to transport items to the first independent transport robot via a first container; and a second conveyor to transport the first container downstream.

12. The system of claim 5, further comprising:

a sensor configured to determine at least one dimension of an item while the item is disposed on the first independent transport robot.

13. The system of claim 5, further comprising:

a third custom-sized package generation machine configured to generate packaging having a third range of dimensions; and a fourth custom-sized package generation machine configured to generate packaging having a fourth range of dimensions;

wherein the first range of dimensions partially overlaps the second range of dimensions, and the third range of dimensions partially overlaps the fourth range of dimensions.

14. The system of claim 5, further comprising:

a controller configured to:

cause a first item to be loaded onto the first independent transport robot at the item induction portion;

determine a first shape of the first item or a first packaging type associated with the first item;

determine that the first item is to be routed to the first custom-sized package generation machine based at least in part on the first shape or the first packaging type; and cause the first independent transport robot to transport the first item to the first custom-sized package generation machine.

15. The system of claim 5, wherein the first custom-sized package generation machine is unable to form wraparound packages.

16. A custom-sized package generation system comprising:

a first custom-sized package generation machine configured to generate packaging having a first range of dimensions;

a second custom-sized package generation machine configured to generate packaging having a second range of dimensions;

a first independent transport robot configured to transport items to at least one of the first and second custom-sized package generation machines; and a controller configured to:

cause a first item to be loaded onto the first independent transport robot at an item induction portion of the system;

determine a first dimension of the first item;

determine that the first item is to be routed to the first custom-sized package generation machine based at least in part on the first dimension and the first range of dimensions; and cause the first independent transport robot to transport the first item to the first custom-sized package generation machine.

17. The custom-sized package generation system of claim 16, wherein the first custom-sized package generation machine and the second custom-sized package generation machine are decoupled from the item induction portion of the system.

18. The custom-sized package generation system of claim 16, wherein the controller is further configured to:

determine that a load on the first custom-sized package generation machine satisfies a reroute threshold;

determine that the first dimension is within the second range of dimensions; and cause the first independent transport robot to transport the first item to the second custom-sized package generation machine instead of the first custom-sized package generation machine.

19. The custom-sized package generation system of claim 16, further comprising:

a second independent transport robot configured to transport items to both the first and second custom-sized package generation machines;

wherein the first independent transport robot is configured to transport items to both the first and second custom-sized package generation machines.

20. The custom-sized package generation system of claim 16, further comprising:

a third custom-sized package generation machine configured to generate packaging having a third range of dimensions; and a fourth custom-sized package generation machine configured to generate packaging having a fourth range of dimensions;

wherein the first range of dimensions partially overlaps the second range of dimensions, and the third range of dimensions partially overlaps the fourth range of dimensions.

* * * * *